US006520872B2

(12) United States Patent
Endo et al.

(10) Patent No.: US 6,520,872 B2
(45) Date of Patent: Feb. 18, 2003

(54) THREE-PIECE SOLID GOLF BALL

(75) Inventors: Seiichiro Endo, Kobe (JP); Keiji Ohama, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 09/983,630

(22) Filed: Oct. 25, 2001

(65) Prior Publication Data

US 2002/0098916 A1 Jul. 25, 2002

(30) Foreign Application Priority Data

Oct. 26, 2000 (JP) ..... 2000-326637

(51) Int. Cl.[7] ..... A63B 37/06

(52) U.S. Cl. ..... 473/374; 473/378; 473/383; 473/384

(58) Field of Search ..... 473/373, 374, 473/383, 384, 378, 367, 368, 370, 371

(56) References Cited

U.S. PATENT DOCUMENTS 4,570,937 A * 2/1986 Yamada ..... 473/372
5,158,300 A 10/1992 Aoyama
5,184,828 A * 2/1993 Kim et al. ..... 473/373
5,403,010 A * 4/1995 Yabuki et al. ..... 473/372
5,490,673 A * 2/1996 Hiraoka ..... 473/372
5,516,110 A * 5/1996 Yabuki et al. ..... 273/DIG. 22
5,697,856 A * 12/1997 Moriyama et al. ..... 473/374
5,782,707 A * 7/1998 Yamagishi et al. ..... 473/373
5,803,833 A * 9/1998 Nakamura et al. ... 273/DIG. 20
5,857,924 A 1/1999 Miyagawa et al.
5,967,908 A 10/1999 Yamagishi et al.
6,174,246 B1 * 1/2001 Hase et al. ..... 473/371
6,390,935 B1 * 5/2002 Sugimoto ..... 473/373
6,390,936 B1 * 5/2002 Sugimoto ..... 473/373

FOREIGN PATENT DOCUMENTS

JP A5-237202 9/1993
JP A9-285566 11/1997
JP A10-305114 11/1998

* cited by examiner

*Primary Examiner*—Steven Wong
*Assistant Examiner*—Raeann Gordon
(74) *Attorney, Agent, or Firm*—Birch, Stewart, Kolasch & Birch, LLP

(57) ABSTRACT

The present invention provides a three-piece solid golf ball, of which flight distance is improved by accomplishing high launch angle and low spin amount in initial flight performance, while maintaining soft and good shot feel at the time of hitting at low head speed. The present invention relates to a three-piece solid golf ball comprising a center, intermediate layer and cover, of which a deformation amount, hardness and hardness distribution of the center, a hardness and thickness of the intermediate layer, a hardness and thickness of the cover, and a hardness distribution from the center to the cover are adjusted to specified ranges.

3 Claims, 3 Drawing Sheets

THREE-PIECE SOLID GOLF BALL

FIELD OF THE INVENTION

The present invention relates to a three-piece solid golf ball. More particularly, it relates to a three-piece solid golf ball, of which flight distance is improved by accomplishing high launch angle and low spin amount in initial flight performance, while maintaining soft and good shot feel when hit at low head speed.

BACKGROUND OF THE INVENTION

In golf balls commercially selling, there are solid golf balls such as two-piece golf ball, three-piece golf ball and the like, and thread wound golf balls. Recently, the two-piece golf ball and three-piece golf ball, of which flight distance can be improved while maintaining soft and good shot feel at the time of hitting as good as the conventional thread wound golf ball, generally occupy the greater part of the golf ball market. Three-piece golf ball have good shot feel while maintaining excellent flight performance, because they can vary hardness distribution and design of golf balls, when compared with the two-piece golf ball.

The three-piece solid golf balls are obtained by inserting an intermediate layer between the core and the cover layer constituting the two-piece solid golf ball and have been described in Japanese Patent Kokai Publication Nos. 313643/1997, 305114/1998 and Japanese Patent Nos. 2570587 and 2658811. In the golf balls, it has been attempted to compromise the balance of flight performance and shot feel at the time of hitting by using thermoplastic resin, such as ionomer resin, thermoplastic elastomer or mixtures thereof, for the intermediate layer, to adjust a hardness, hardness distribution and the like of the core, intermediate layer and cover to proper ranges.

In Japanese Patent Kokai Publication No. 313643/1997, a three-piece solid golf ball, of which an intermediate layer is placed between a core and a cover is described. The core has a center hardness in JIS-C hardness of not more than 75 and has a surface hardness in JIS-C hardness of not more than 85, the surface hardness is higher than the center hardness by 5 to 25, a hardness of the intermediate layer is higher than the surface hardness of the core by less than 10, and a hardness of the cover is higher than the hardness of the intermediate layer.

In Japanese Patent No. 2570587, a multi-piece solid golf ball which comprises a multi-layer structured solid core composed of an inner core and at least one layer of outer core, and a cover is described. The outer core has a Shore D hardness of 30 to 50 and is mainly formed from a mixture of

- 100 to 50% by weight of polyether ester type thermoplastic elastomer having a glass transition temperature of not more than −25° C. as determined by differential thermal analysis (DSC); and
- 0 to 50% by weight of ethylene-(meth)acrylate copolymer ionomer having a flexural modulus of 200 to 400 MPa; and
- the cover is formed from ethylene-(meth)acrylate copolymer ionomer having a flexural modulus of 200 to 450 MPa and a Shore D hardness of 55 to 68.

In Japanese Patent No. 2658811, a three-piece solid golf ball of which an intermediate layer is placed between a center core and a cover is described. The center core has a diameter of not less than 26 mm, a specific gravity of less than 1.4 and a JIS-C hardness of not more than 80, the intermediate layer has a thickness of not less than 1 mm, a specific gravity of less than 1.2 and a JIS-C hardness of less than 80, and the cover has a thickness of 1 to 3 mm and a JIS-C hardness of not less than 85.

In Japanese Patent Kokai Publication No. 305114/1998, a golf ball of which an intermediate layer is placed between a solid core and a cover, of which the surface of the cover has many dimples, is described. The core has a surface hardness in Shore D hardness of not more than 48, the intermediate layer has a hardness in Shore D hardness of 53 to 60 and the hardness of the intermediate layer is higher than the surface hardness of the core by not less than 8, the cover has a hardness in Shore D hardness of 55 to 65 and the hardness of the cover is higher than that of the intermediate layer, the dimples are consisted of two types having different diameter and/or depth from each other, the total number of the dimples is within the range of 370 to 450, the dimples cover at least 63% of the ball surface, and the index $D_{st}$ of the overall dimple surface area is at least 4.

However, in the golf balls described above, it has been problem that when hit at low head speed by a driver or iron club, high launch angle and low spin amount are not accomplished, and flight performances is degraded, or shot feel is hard and poor. In addition, the problem has not been considered.

OBJECTS OF THE INVENTION

A main object of the present invention is to provide a three-piece solid golf ball, of which flight distance is improved by accomplishing high launch angle and low spin amount in initial flight performance, while maintaining soft and good shot feel, when hit at low head speed in addition to high and middle head speed by a driver or an iron club.

According to the present invention, the object described above has been accomplished by providing a three-piece solid golf ball, of which an intermediate layer is placed between a center and a cover, and by adjusting a deformation amount, hardness and hardness distribution of the center, a hardness and thickness of the intermediate layer, a hardness and thickness of the cover, and a hardness distribution from the center to the cover to specified ranges, thereby providing a three-piece solid golf ball, of which flight distance is improved by accomplishing high launch angle and low spin amount in initial flight performance, while maintaining soft and good shot feel when hit at low head speed.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accomplishing drawings which are given by way of illustrating only, and thus are not limitative of the present invention, and wherein.

SUMMARY OF THE INVENTION

The present invention provides a three-piece solid golf ball comprising a center, an intermediate layer formed on the center and a cover covering the intermediate layer, of which the surface of the cover has many dimples, wherein the center has a deformation amount of 4.0 to 6.0 mm, when applying from an initial load of 98 N to a final load of 1275 N, a central point hardness in Shore D hardness ($H_C$) of 17 to 40, a surface hardness in Shore D hardness ($H_S$) of 30 to 55 and a difference ($H_S$—$H_C$) between the surface hardness and central point hardness of 10 to 20, assuming that Shore D hardness at the distance of 5, 10 and 15 mm from the central point of the center is represented by $H_5$, $H_{10}$ and $H_{15}$, respectively, the $H_5$, $H_{10}$ and $H_{15}$ satisfy a correlation represented by the following formula: $H_C<H_5<H_{10}<H_{15}\leqq H_S$, and assuming that a distance from the central point of the center is represented by X (mm) and Shore D hardness at the distance X is represented by Y, the X and Y satisfy a correlation represented by the following formula:

$$0.7X+17\leqq Y<0.8X+40$$

the intermediate layer is mainly formed from thermoplastic resin, and has a hardness in Shore D hardness ($H_M$) of 48 to 62 and thickness of 1.0 to 1.8 mm, the cover is mainly formed from thermoplastic resin, and has a hardness in Shore D hardness ($H_L$) of 58 to 72 and thickness of 1.0 to 2.5 mm, the $H_S$, $H_M$ and $H_L$ satisfy a correlation represented by the following formula:

$$H_S<H_M<H_L$$

and a hardness difference ($H_L$–$H_M$) is within the range of 5 to 15 and a hardness difference ($H_M$–$H_S$) is within the range of 10 to 20, and a number of the dimple having an angle between a radial tangent line (A) at the dimple edge and a tangent line (B) at the dimple edge of a circle drawn through the dimple edge and the deepest point of the dimple is within the range of 8 to 25° is not less than 50%, based on total number of the dimples in the golf ball.

In order to put the present invention into a more suitable practical application, it is preferable that the intermediate layer and the cover are formed from thermoplastic resin comprising ionomer resin as a main component; and the total number of the dimple is within the range of 450 to 540.

DETAILED DESCRIPTION OF THE INVENTION

Figure 1:
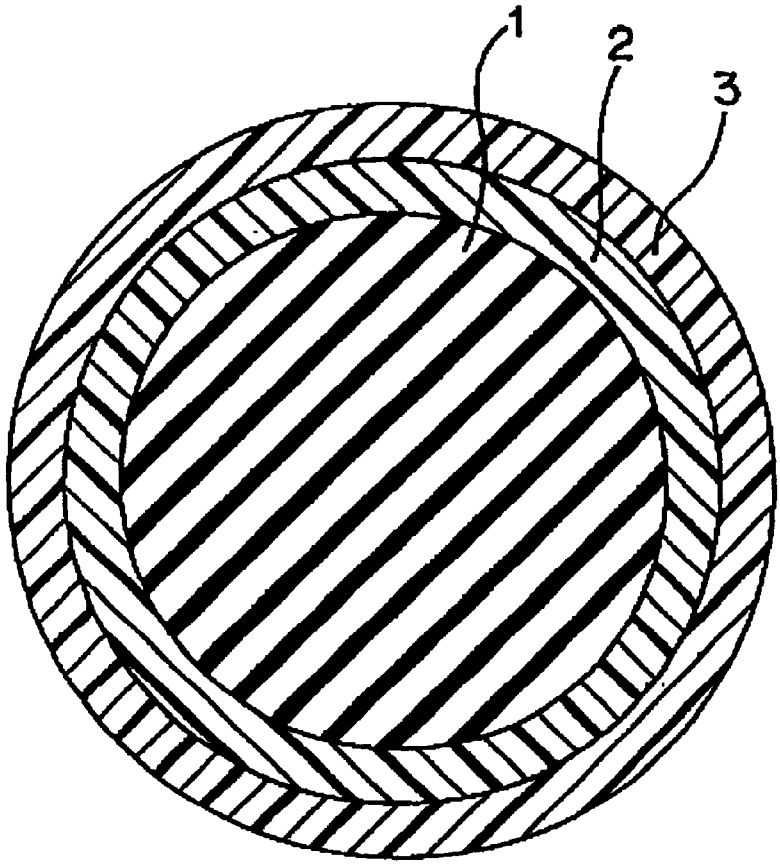
FIG. 1 is a schematic cross section illustrating one embodiment of the golf ball of the present invention.

The three-piece solid golf ball of the present invention will be explained with reference to the accompanying drawing in detail. FIG. 1 is a schematic cross section illustrating one embodiment of the three-piece solid golf ball of the present invention. As shown in FIG. 1, the golf ball of the present invention comprises a center 1, an intermediate layer 2 formed on the center and a cover 3 formed on the intermediate layer. The center 1 of the golf ball of the present invention is formed from a rubber composition comprising a base rubber, a co-crosslinking agent, an organic peroxide, a filler and the like.

The base rubber used in the present invention may be synthetic rubber, which has been conventionally used for cores of solid golf balls. Preferred is so-called high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like.

Examples of the co-crosslinking agents are not limited, but include a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.). The preferred co-crosslinking agent is zinc acrylate, because it imparts high rebound characteristics to the resulting golf ball. The amount of the co-crosslinking agent is preferably from 20 to 30 parts by weight, more preferably from 21 to 29 parts by weight, based on 100 parts by weight of the base rubber. When the amount of the co-crosslinking agent is smaller than 20 parts by weight, the center is too soft, and the rebound characteristics are degraded, which reduces the flight distance. On the other hand, when the amount of the co-crosslinking agent is larger than 30 parts by weight, the center is too hard, and the shot feel of the resulting golf ball is poor.

The organic peroxide includes, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is preferably from 0.1 to 3.0 parts by weight, more preferably from 0.1 to 2.8 parts by weight, most preferably from 0.2 to 2.5 parts by weight based on 100 parts by weight of the base rubber. When the amount of the organic peroxide is smaller than 0.1 parts by weight, the center is too soft, and the rebound characteristics are degraded, which reduces the flight distance. On the other hand, when the amount of the organic peroxide is larger than 3.0 parts by weight, the center is too hard, and the shot feel is poor.

The filler, which can be typically used for the core of solid golf ball, includes for example, inorganic filler (such as zinc oxide, barium sulfate, calcium carbonate, magnesium oxide and the like), high specific gravity metal powder filler (such as tungsten powder, molybdenum powder and the like), and the mixture thereof.

Where appropriate, it is possible to compound a component which is typically used in the manufacture of solid golf ball cores together with the rubber composition; e.g., other additives such as antioxidants, peptizing agents and the like. If used, preferably the amount of the amount of the antioxidant is 0.2 to 5.0 parts by weight, based on 100 parts by weight of the base rubber.

The center 1 used for the golf ball of the present invention can be obtained by mixing, and then vulcanizing and press-molding the above rubber composition under applied heat in a mold. The vulcanization condition is not limited, but the vulcanization may be conducted at 130 to 240° C. and 2.9 to 11.8 MPa for 15 to 60 minutes.

In the golf ball of the present invention, it is required for the center 1 to have a deformation amount when applying from an initial load of 98 N to a final load of 1275 N of 4.0 to 6.0 mm, preferably 4.1 to 5.9 mm, more preferably 4.2 to 5.8 mm. When the deformation amount of the center is smaller than 4.0 mm, the center is too hard, and the shot feel of the resulting golf ball is poor. In addition, the launch angle is low and the spin amount is large, and the flight performance is degraded. On the other hand, when the deformation amount is larger than 6.0 mm, the center is too soft, and the rebound characteristics are degraded, which reduces the flight distance. In addition, the durability of the resulting golf ball is degraded.

In the golf ball of the present invention, it is required for the center 1 to have a central point hardness ($H_C$) in Shore D hardness of 17 to 40, preferably 18 to 39, more preferably 19 to 38. When the central point hardness is lower than 17, the center is too soft, and the rebound characteristics are degraded. On the other hand, the central point hardness is higher than 40, the center is too hard, and the shot feel is poor. In addition, the launch angle is low and the spin amount is large, and the flight performance is degraded.

In the golf ball of the present invention, it is required for the center 1 to have the surface hardness ($H_S$) in Shore D hardness of 30 to 55, preferably 31 to 54, more preferably 31 to 53. When the surface hardness is lower than 30, the center is too soft, and the rebound characteristics of the resulting golf ball are degraded. In addition, the launch angle is low and the spin amount is large, and the flight performance is degraded. On the other hand, when the surface hardness is higher than 55, the center is too hard, and the shot feel of the resulting golf ball is poor. The term "a surface hardness of the center" as used herein refers to the hardness, which is determined by measuring a hardness at the surface of the resulting center.

In the golf ball of the present invention, it is required for the center 1 to have a difference ($H_S$–$H_C$) between the surface hardness and central point hardness of 10 to 20, preferably 10 to 19, more preferably 10 to 18. When the hardness difference is smaller than 10, the center is too hard, and the shot feel is poor. In addition, the launch angle is low and the spin amount is large, and the flight performance is degraded. On the other hand, when the hardness difference is larger than 20, the center is too hard, and the rebound characteristics are degraded, which degrades the flight performance.

In the golf ball of the present invention, assuming that Shore D hardness at the distance of 5, 10 and 15 mm from the central point of the center is represented by $H_5$, $H_{10}$ and $H_{15}$, respectively, it is required for the center 1 to satisfy a correlation represented by the following formula (1):

$$H_C<H_5<H_{10}<H_{15}<H_S \quad (1)$$

That is, the center has a hardness distribution such that the hardness of the center increases gradually from the central point to the surface.

When the center has even hardness distribution, that is, the center satisfies a correlation represented by the following formula:

$$H_C=H_5=H_{10}=H_{15}=H_S,$$

the shot feel is heavy and poor, or the launch angle is low and the spin amount is large, which degrades the flight performance.

When the center has a hardness distribution such that the hardness has a peak from the central point to the distance of 5 mm or 10 mm from the central point, that is, the center satisfies a correlation represented by the following formula:

$$H_C<H_5>H_{10}>H_{15}>H_S,$$

or $$H_C<H_5<H_{10}>H_{15}>H_S,$$

the shot feel is heavy and poor, or the launch angle is low and the spin amount is large, which degrades the flight performance.

When the center has a hardness distribution such that the hardness of the center increases gradually from the surface to the central point, that is, the center satisfies a correlation represented by the following formula:

$$H_C>H_5>H_{10}>H_{15}>H_S,$$

the shot feel is heavy and poor, or the launch angle is low and the spin amount is large, which degrades the flight performance. The term "a central point hardness, a hardness at the distance of 5, 10 and 15 mm from the central point of the center" as used herein refers to the hardness, which is determined by cutting the resulting center into two equal parts and then measuring a hardness at its center point and the distance of 5, 10 and 15 mm from the central point in section.

In the golf ball of the present invention, assuming that a distance from the central point of the center is represented by X (mm) and Shore D hardness measured at the distance X is represented by Y, it is required for the center 1 to satisfy a correlation represented by the following formula (2):

$$0.7X+17<Y<0.8X+40 \quad (2)$$

When making a graph of a correlation of the distance X from the central point as x-axis with the hardness Y as y-axis, it is shown by the above formula that the hardness in Shore D hardness of the center, that is, $H_C$, $H_5$, $H_{10}$, $H_{15}$ and $H_S$, are on the line or within the area having higher Y value than the line represented by the following formula:

$$Y=0.7X+17$$

and are on the line or within the area having lower Y value than the line represented by the following formula:

$$Y=0.8X+40$$

When the hardness of the center is within the range represented by the following formula:

$$Y>0.8X+40,$$

the shot feel is hard and poor. On the other hand, when the hardness of the center is within the range represented by the following formula:

$$Y<0.7X+17,$$

the rebound characteristics are degraded, which reduces the flight performance.

When at least one of the $H_{10}$, $H_{15}$ and $H_S$ is within the range represented by the following formula:

$$Y>0.8X+40,$$

the shot feel is hard and poor. When each or both of the $H_C$ and $H_5$ is within the range represented by the following formula:

$$Y>0.8X+40,$$

the shot feel is hard and poor. When at least one of the $H_{10}$, $H_{15}$ and $H_S$ is within the range represented by the following formula:

$$Y<0.7X+17,$$

the shot feel is heavy and poor. In addition, the launch angle is low and the spin amount is large, which degrades the flight performance.

In the golf ball of the present invention, it is desired for the center to have a specific gravity of 1.05 to 1.25, preferably 1.10 to 1.25. When the specific gravity is smaller than 1.05, the amount of the filler is too small, and the durability is degraded. On the other hand, when the specific gravity is larger than 1.25, the amount of the filler is too large, and the rubber content in the center is small, which degrades the rebound characteristics.

In the golf ball of the present invention, it is suitable for the center 1 to have a diameter of 34.2 to 38.8 mm, preferably 34.4 to 37.6 mm. When the diameter of the center 1 is smaller than 34.2 mm, the technical effects of improving the rebound characteristics accomplished by the presence of the center are sufficiently obtained. On the other hand, when the diameter is larger than 38.8 mm, the thickness of the intermediate layer and that of the cover are too small, and the technical effects accomplished by the presence of the intermediate layer and cover are not sufficiently obtained. The intermediate layer 2 is then formed on the center 1.

The intermediate layer 2 of the present invention contains thermoplastic resin, particularly ionomer resin, which has been conventionally used for the cover of golf balls, as a base resin. The ionomer resin may be a copolymer of α-olefin and α,β-unsaturated carboxylic acid, of which a portion of carboxylic acid groups is neutralized with metal ion, or a terpolymer of α-olefin, α,β-unsaturated carboxylic acid and α,β-unsaturated carboxylic acid ester, of which a portion of carboxylic acid groups is neutralized with metal ion. Examples of the α-olefins in the ionomer preferably include ethylene, propylene and the like. Examples of the α,β-unsaturated carboxylic acid in the ionomer include acrylic acid, methacrylic acid, fumaric acid, maleic acid, crotonic acid and the like, preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid, crotonic acid and the like. Preferred are acrylic acid esters and methacrylic acid esters. The metal ion which neutralizes a portion of carboxylic acid groups of the copolymer or terpolymer includes an alkali metal ion, such as a sodium ion, a potassium ion, a lithium ion and the like; a divalent metal ion, such as a zinc ion, a calcium ion, a magnesium ion and the like; a trivalent metal ion, such as an aluminum, a neodymium ion and the like; and mixture thereof. Preferred are sodium ions, zinc ions, lithium ions, magnesium ions and the like, in view of rebound characteristics, durability and the like.

The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1601, Hi-milan 1605, Hi-milan 1652, Hi-milan 1702, Hi-milan 1705, Hi-milan 1706, Hi-milan 1707, Hi-milan 1855, Hi-milan 1856, Hi-milan AM7316 and the like. Examples of the ionomer resins, which are commercially available from Du Pont Co., include Surlyn 8945, Surlyn 9945, Surlyn 6320, Surlyn 8320, Surlyn AD8511 and the like. Examples of the ionomer resins, which are commercially available from Exxon Chemical Co., include Iotek 7010, Iotek 8000 and the like. These ionomer resins may be used alone or in combination.

As the materials suitably used in the intermediate layer 2 of the present invention, the above ionomer resin may be used alone, but the ionomer resin may be used in combination with at least one of thermoplastic elastomer, diene-based block copolymer and the like. Examples of the thermoplastic elastomers are not limited, but include polyamide-based thermoplastic elastomer, polyester-based thermoplastic elastomer, polyurethane-based elastomer, thermoplastic elastomer having terminal OH groups and the like.

Examples of the thermoplastic elastomers, which are commercially available, include polyamide-based thermoplastic elastomer, which is commercially available from Toray Co., Ltd. under the trade name of "Pebax" (such as "Pebax 2533"); polyester-based thermoplastic elastomer, which is commercially available from Toray-Du Pont Co., Ltd. under the trade name of "Hytrel" (such as "Hytrel 3548", "Hytrel 4047"); polyurethane-based thermoplastic elastomer, which is commercially available from Takeda Badische Co., Ltd. under the trade name of "Elastollan" (such as "Elastollan ET880"); and the like.

The diene-based block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof.

Examples of the diene-based block copolymers include styrene-butadiene-styrene (SBS) block copolymer, styrene-isoprene-styrene (SIS) block copolymer, styrene-isoprene-butadiene-styrene (SIBS) block copolymer, or hydrogenation products thereof. The diene-based block copolymers may be modified with epoxy groups and the like or may be polymer alloys thereof with the other polymer. As a hydrogenation product of the SBS, styrene-ethylene-butylene-styrene (SEBS) block copolymer may be used; as a hydrogenation product of the SIS, styrene-ethylene-propylene-styrene (SEPS) block copolymer may be used; and as a hydrogenation product of the SIBS, styrene-ethylene-ethylene-propylene-styrene (SEEPS) block copolymer may be used.

Examples of the preferred diene-based block copolymers include styrene-butadiene-styrene (SBS) block copolymer comprising polybutadiene block containing epoxy groups or styrene-isoprene-styrene (SIS) block copolymer comprising polyisoprene block containing epoxy groups, or hydrogenation products thereof, polymer alloys of hydrogenation product of the SBS block copolymer and the other polymer, and the like. Examples of the diene-based block copolymers, which are commercially available, include the diene-based block copolymers, which are commercially available from Daicel Chemical Industries, Ltd. under the trade name of "Epofriend" (such as "Epofriend A110" and the like), the diene-based block copolymers, which are commercially available from Kuraray Co., Ltd. under the trade name of "Septon" (such as "Septon HG-252" and the like), the diene-based block copolymers, which are commercially available from Mitsubishi Chemical Co., Ltd. under the trade name of "Rabalon" (such as "Rabalon SR04" and the like), and the like.

The amount of the thermoplastic elastomer or diene-based block copolymer is 10 to 50 parts by weight, preferably 15 to 40 parts by weight, based on 100 parts by weight of the base resin for the intermediate layer. When the amount is smaller than 10 parts by weight, the technical effects of improving shot feel accomplished by the presence of the thermoplastic elastomer or diene-based block copolymer are sufficiently obtained. On the other hand, when the amount is larger than 50 parts by weight, the intermediate layer is too soft and the rebound characteristics are degraded, or the compatibility with the ionomer resin is degraded and the durability is degraded.

In the golf ball of the present invention, the resin composition for the intermediate layer, which has a specific gravity of 0.90 to 1.25, may optionally contain a filler. Examples of the fillers, which are the same as used in the center 1 and have been typically used in cores of golf balls, inorganic filler (such as zinc oxide, barium sulfate, calcium carbonate, magnesium oxide and the like), high specific gravity metal powder filler (such as tungsten powder, molybdenum powder and the like), and the mixture thereof.

The intermediate layer 2 of the present invention may be formed by conventional methods, which have been known to the art and used for forming the cover of the golf balls. For example, there can be used a method comprising molding the intermediate layer composition into a semi-spherical half-shell, then covering the center with the two half-shells, followed by pressure molding, or a method comprising injection molding the composition for the intermediate layer directly on the center to cover it.

In the golf ball of the present invention, it is required for the intermediate layer 2 to have a hardness ($H_M$) in Shore D hardness of 48 to 62, preferably 49 to 61, more preferably 50 to 60. When the hardness is lower than 48, the rebound characteristics of the resulting golf ball are degraded; and the launch angle is low, and the flight performance is degraded. In addition, the shot feel is poor. On the other hand, when the hardness is higher than 62, the intermediate layer is too hard, and the shot feel of the resulting golf ball is hard and poor. The term "a hardness of the intermediate layer" as used herein refers to the hardness, which is determined by measuring a hardness using a sample of a slab obtained from the composition for the intermediate layer.

It is required for the intermediate layer 2 to have a thickness of 1.0 to 1.8 mm, preferably 1.1 to 1.8 mm, more preferably 1.1 to 1.7 mm. When the thickness of the intermediate layer is smaller than 1.0 mm, the technical effects accomplished by the presence of the intermediate layer are sufficiently obtained, and the shot feel is poor. In addition, it is difficult to injection mold. On the other hand, when the thickness is larger than 1.8 mm, the rebound characteristics are degraded, which reduces the flight distance, and the shot feel is poor. The cover 3 is then formed on the intermediate layer 2.

In the golf ball of the present invention, the cover may comprises resins, such as thermoplastic resins, thermosetting resins and the like, as a base resin. Preferred are thermoplastic resins, such as particularly the ionomer resin, which is the same as used in the intermediate layer, or mixtures thereof. As the materials suitably used in the intermediate layer 2 of the present invention, the above ionomer resin may be used alone, but the ionomer resin may be used in combination with at least one of thermoplastic elastomer, diene-based block copolymer and the like, which is the same as used in the intermediate layer.

In the golf ball of the present invention, the cover composition may optionally contain fillers such as barium sulfate, pigments such as titanium dioxide, and other additives (such as a dispersant, an antioxidant, a UV absorber, a photostabilizer and a fluorescent agent or a fluorescent brightener, etc.), in addition to the resin component, as long as the addition of the additive does not deteriorate the desired performance of the golf ball cover. If used, the amount of the pigment is preferably 0.1 to 5.0 parts by weight, based on the 100 parts by weight of the base resin of the cover.

In the golf ball of the present invention, it is required for the cover 3 to have a thickness of 1.0 to 2.5 mm, preferably 1.1 to 2.5 mm, more preferably 1.1 to 2.4 mm. When the thickness of the cover is smaller than 1.0 mm, the rebound characteristics are degraded, which reduces the flight distance. In addition, it is difficult to injection mold. On the other hand, when the thickness is larger than 2.5 mm, the resulting golf ball is too hard, and the shot feel is poor.

In the golf ball of the present invention, it is required for the cover 3 to have a hardness (HL) in Shore D hardness of 58 to 72, preferably 59 to 71, more preferably 60 to 70. When the hardness is lower than 58, the rebound characteristics of the resulting golf ball are degraded; and the launch angle is low, and the flight performance is degraded. In addition, the shot feel is heavy and poor. On the other hand, when the hardness is higher than 72, the cover is too hard, and the shot feel of the resulting golf ball is hard and poor. The term "a hardness of the cover" as used herein refers to the hardness, which is determined by measuring a hardness using a sample of a slab obtained from the composition for the cover.

In the golf ball of the present invention, it is required for the surface hardness of the core ($H_S$), the intermediate layer hardness ($H_M$) and the cover hardness ($H_L$) to satisfy a correlation represented by the following formula:

$$H_S<H_M<H_L.$$

When the $H_S$, $H_M$ and $H_L$ do not satisfy the correlation, the shot feel is heavy or hard and poor.

In the golf ball of the present invention, it is required for the hardness difference ($H_L-H_M$) to be within the range of 5 to 15, preferably 6 to 14, more preferably 6 to 13. When the hardness difference is smaller than 5, the launch angle is low, and the flight performance is degraded. In addition, the shot feel is poor. On the other hand, when the hardness difference is larger than 15, the rebound characteristics are degraded, and the flight performance is degraded.

In the golf ball of the present invention, it is required for the hardness difference ($H_M-H_S$) to be within the range of 10 to 20, preferably 11 to 19, more preferably 11 to 18. When the hardness difference is smaller than 10, the launch angle is low, and the flight performance is degraded. In addition, the shot feel is poor. On the other hand, when the hardness difference is larger than 20, the rebound characteristics are degraded, and the flight performance is degraded.

The cover of the present invention may be formed by the same methods as used in the intermediate layer. At the time of molding the cover, many depressions called "dimples" are formed on the surface of the golf ball. Furthermore, paint finishing or marking with a stamp may be optionally provided after the cover is molded for commercial purposes.

Figure 2:
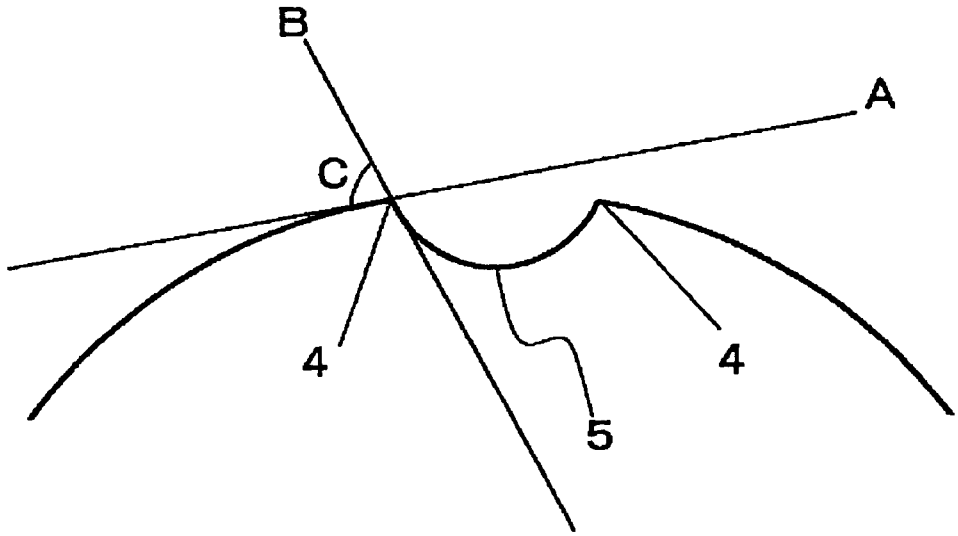
FIG. 2 is a schematic cross section illustrating one embodiment of a dimple of the golf ball of the present invention.
Figure 3:
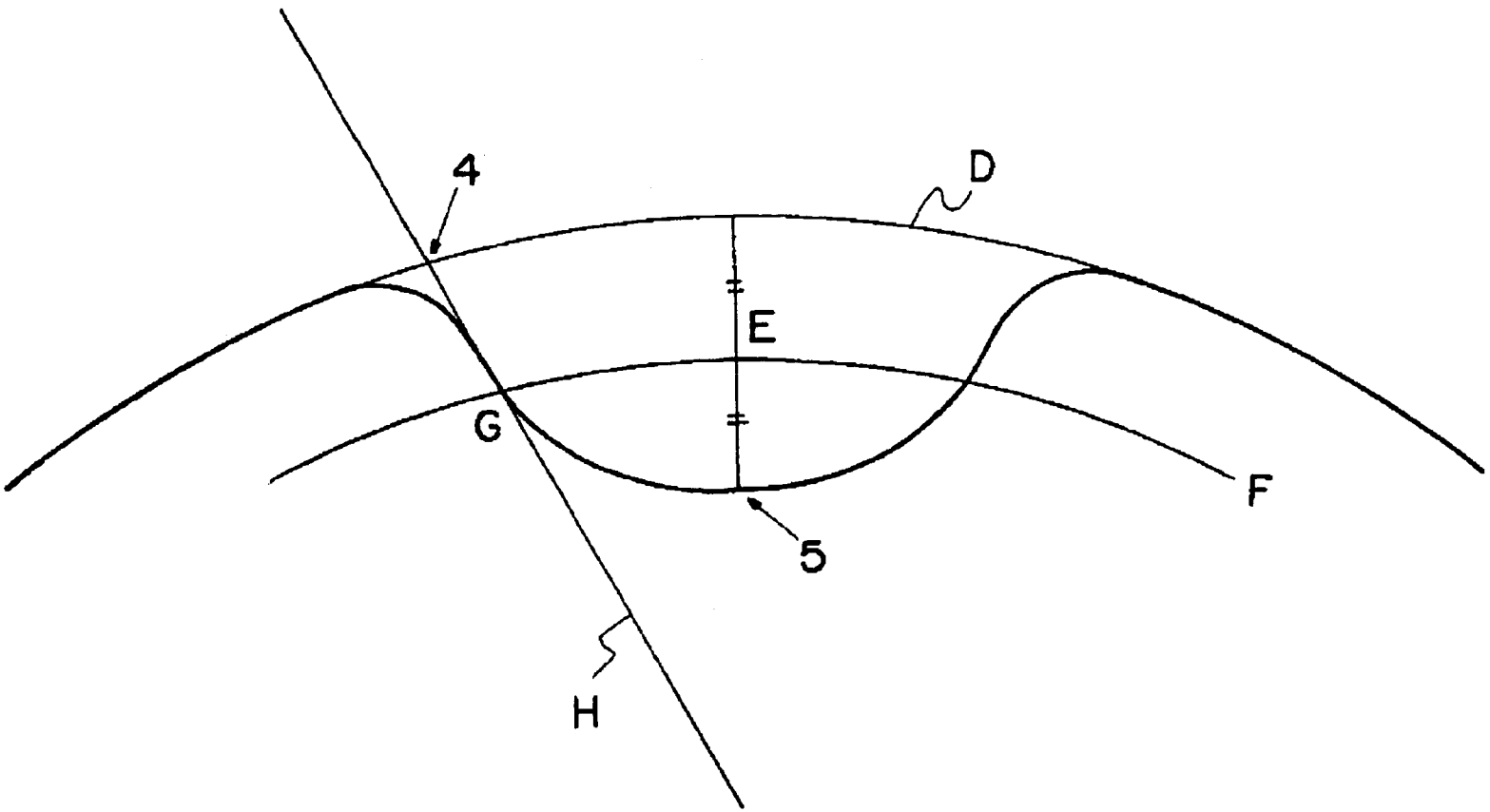
FIG. 3 is a schematic cross section illustrating one embodiment of a dimple of the golf ball of the present invention.

In the golf ball of the present invention, it is required that a number of the dimple having an angle between a radial tangent line (A) at the dimple edge and a tangent line (B) at the dimple edge of a circle drawn through the dimple edge and the deepest point of the dimple is within the range of 8 to 25° is not less than 50%, based on total number of the dimples in the golf ball. It will be explained with reference to the accompanying drawing in detail. FIG. 2 is a schematic cross section illustrating one embodiment of a dimple of the golf ball of the present invention. As shown in FIG. 2, the angle between a radial tangent line (A) at the dimple edge 4 and a tangent line (B) at the dimple edge 4 of a circle drawn through the dimple edge 4 and the deepest point 5 of the dimple is an angle (C). In the golf ball of the present invention, it is required for the angle (C) to be within the range of 8 to 25°, preferably 9 to 23°, more preferably 10 to 20°, and it is required for the dimple to have a number of not less than 50%, preferably not less than 55%, more preferably 60 to 100%, based on total number of the dimples in the golf ball. When the angle (C) is smaller than 8°, the resulting golf ball creates blown-up trajectory, which reduces the flight distance. On the other hand, when the angle (C) is larger than 25°, the launch angle is low, which reduces the flight distance. In addition, when the angle (C) is larger than 25°, if provided the paint finishing or marking with a stamp, the thickness of the paint layer is large, and the durability of the resulting golf ball is degraded. When the number of the dimple having the angle (C) is less than 50%, based on total number of the dimples in the golf ball, the technical effects accomplished by the presence of the dimple are not sufficiently obtained, which reduces the flight distance.

When the dimple edge is roundish after applying paint on the cover, the dimple edge is a point of intersection of a phantom circle (D) and a tangent line (H) of the dimple at a point (G) of contact between the dimple and a concentric circle (F) of the phantom circle (D) drawn through the central point (E) of the distance from the phantom circle (D) of the golf ball to the deepest point 5 of the dimple. The phantom circle (D) of the golf ball is a contour circle of the golf ball assuming that it is a true sphere having no dimples on the surface thereof.

The dimple having the angle (C) adjusted to the above range is circular, and may be single radius or double radius, or combination thereof. It is suitable for the dimple to have a diameter of 2.0 to 5.0 mm, preferably 2.3 to 5.4 mm. When the diameter is smaller than 2.0 mm, the technical effects accomplished by the presence of the dimple are sufficiently obtained. On the other hand, when the diameter is larger than 5.0 mm, the surface appearance is poor and the flight performance is degraded.

The dimple other than the dimple having the angle may be circular or non-circular. When the dimple is circular, it may be single radius or double radius, or combination thereof. On the other hand, when the dimple is non-circular, it may be polygonal, star, oval and the like.

In the golf ball of the present invention, since high launch angle and low spin amount is accomplished by the structure of the dimple, it is preferable to adjust the number and total volume of the dimple and the ratio of the golf ball surface occupied by the dimple to proper ranges. In the golf ball of the present invention, it is desired for the dimple to have a number of 450 to 540, preferably 450 to 500. When the number of the dimple is smaller than 450, the resulting golf ball creates blown-up trajectory when hit by a driver, which reduces the flight distance. On the other hand, when the number of the dimple is larger than 540, the trajectory of the resulting golf ball is too low, which reduces the flight distance.

In the golf ball of the present invention, it is desired for the dimple to have a total volume of 290 to 340 $mm^3$, preferably 295 to 335 $mm^3$. When the total volume of the dimple is smaller than 290 $mm^3$, the resulting golf ball creates blown-up trajectory when hit by a driver, which reduces the flight distance. On the other hand, when the total dimple volume is larger than 340 $mm^3$, the trajectory of the resulting golf ball is too low, which reduces the flight distance. The term "total volume of the dimple" refers to the sum of a volume of a space enclosed by a concave of the dimple and a plane passed through an edge of the dimple.

In the golf ball of the present invention, it is desired for the dimple to have a ratio of the golf ball surface occupied by the dimple of 65 to 85%, preferably 70 to 85%, based on the total surface area of the golf ball. When the ratio of the golf ball surface occupied by the dimple is smaller than 65%, the technical effects accomplished by the presence of the dimple are sufficiently obtained, which reduces the flight distance. On the other hand, when the ratio of the golf ball surface occupied by the dimple is larger than 85%, the resulting golf ball creates blown-up trajectory when hit by a driver, which reduces the flight distance. The total volume of the dimple and the ratio of the golf ball surface occupied by the dimple as used herein are determined by measuring at the surface of the resulting golf ball, and if paint is applied on the cover, they are determined by measuring at the surface of the applied golf ball.

The three-piece solid golf ball of the present invention is formed to a diameter of at least 42.67 mm and a weight of no more than 45.93 g, in accordance with the regulations for golf balls.

EXAMPLES

The following Examples and Comparative Examples further illustrate the present invention in detail but are not to be construed to limit the scope of the present invention.

Examples 1 to 8 and Comparative Examples 1 to 14

Production of Center

The rubber compositions for the center having the formulations shown in Tables 1 to 4 were mixed with a mixing roll, and then vulcanized by press-molding at the vulcanization condition shown in the same Tables to obtain spherical centers. The diameter, deformation amount and hardness distribution in Shore D hardness (i.e. the central point hardness ($H_C$), the hardness at the distance of 5 mm from the central point ($H_5$), the hardness at the distance of 10 mm from the central point ($H_{10}$), the hardness at the distance of 15 mm from the central point ($H_{15}$) and the surface hardness ($H_S$)) of the resulting center were measured, and the hardness difference ($H_S$–$H_C$) was determined by calculation. The results are shown in Tables 9 to 12.

TABLE 1

(parts by weight)

| Center composition | | Example No. 1 | 2 | 3 | 4 | 5 | 6 |
|---|---|---|---|---|---|---|---|
| BR18 *1 | | 100 | 100 | 100 | 100 | 100 | 100 |
| Zinc acrylate | | 24 | 22 | 26.5 | 24 | 22 | 28 |
| Zinc oxide | | 28.5 | 30 | 26 | 28.5 | 30 | 23.5 |
| Dicumyl peroxide | | 0.7 | 1.0 | 1.0 | 0.7 | 1.0 | 0.5 |
| Diphenyl disulfide | | 0.5 | 0.6 | 0.6 | 0.5 | 0.6 | 0.5 |
| Vulcanization condition | | | | | | | |
| The first stage | Temp. (° C.) | 160 | 160 | 160 | 155 | 160 | 160 |
| | Time (min.) | 22 | 20 | 25 | 25 | 20 | 20 |
| The second stage | Temp. (° C.) | — | — | — | 170 | — | — |
| | Time (min.) | — | — | — | 10 | — | — |

TABLE 2

(parts by weight)

| Center composition | | Example No. 7 | 8 | Comparative Example No. 1 | 2 | 3 | 4 |
|---|---|---|---|---|---|---|---|
| BR18 *1 | | 100 | 100 | 100 | 100 | 100 | 100 |
| Zinc acrylate | | 24 | 24 | 24 | 24 | 20 | 31 |
| Zinc oxide | | 28.5 | 28.5 | 28.5 | 28.5 | 30 | 19 |
| Dicumyl peroxide | | 0.7 | 0.7 | 0.7 | 0.7 | 0.6 | 0.5 |
| Diphenyl disulfide | | 0.5 | 0.5 | 0.5 | 0.5 | 1.0 | 0.5 |
| Vulcanization condition | | | | | | | |
| The first stage | Temp. (° C.) | 160 | 160 | 144 | 160 | 160 | 144 |
| | Time (min.) | 22 | 22 | 25 | 22 | 22 | 25 |
| The second stage | Temp. (° C.) | — | — | 165 | — | — | 165 |
| | Time (min.) | — | — | 8 | — | — | 8 |

TABLE 3

(parts by weight)

| Center composition | | Comparative Example No. 5 | 6 | 7 | 8 | 9 | 10 |
|---|---|---|---|---|---|---|---|
| BR18 *1 | | 100 | 100 | 100 | 100 | 100 | 100 |
| Zinc acrylate | | 24 | 24 | 24 | 24 | 27 | 27 |
| Zinc oxide | | 28.5 | 28.5 | 28.5 | 28.5 | 25 | 25.5 |
| Dicumyl peroxide | | 0.7 | 0.7 | 0.7 | 0.7 | 0.5 | 0.5 |
| Diphenyl disulfide | | 0.5 | 0.5 | 0.5 | 0.5 | 0.5 | 0.5 |
| Vulcanization condition | | | | | | | |
| The first stage | Temp. (° C.) | 150 | 160 | 160 | 160 | 160 | 160 |
| | Time (min) | 35 | 22 | 22 | 22 | 22 | 22 |
| The second stage | Temp. (° C.) | — | — | — | — | — | — |
| | Time (min) | — | — | — | — | — | — |

TABLE 4

(parts by weight)

| Center composition | | Comparative Example No. 11 | 12 | 13 | 14 |
|---|---|---|---|---|---|
| BR18 *1 | | 100 | 100 | — | — |
| BR01 *2 | | — | — | 100 | 100 |
| Zinc acrylate | | 19.5 | 24 | 33.2 | 33.2 |
| Zinc oxide | | 31.8 | 28.2 | 10 | 10 |
| Dicumyl peroxide | | 0.6 | 1.0 | 0.9 | 0.9 |
| Perhexa 3M-40 *3 | | — | 0.3 | — | — |

TABLE 4-continued (parts by weight)

| Center composition | | Comparative Example No. 11 | 12 | 13 | 14 |
|---|---|---|---|---|---|
| Peptizing agent | | 1.0 | — | — | — |
| Antioxidant | | 0.1 | — | 0.2 | 0.2 |
| Vulcanization condition | | | | | |
| The first stage | Temp. (° C.) | 155 | 160 | 155 | 155 |
| | Time (min) | 20 | 20 | 15 | 15 |
| The second stage | Temp. (° C.) | — | — | — | — |
| | Time (min) | — | — | — | — |

*1: High-cis Polybutadiene rubber (trade name "BR18") available from JSR Co., Ltd. (Content of 1,4-cis-polybutadiene: 96%)
*2: High-cis Polybutadiene rubber (trade name "BR01") available from JSR Co., Ltd. (Content of 1,4-cis-polybutadiene: 96%)
*3: 1,1-bis(t-butylperoxy)-3,3,5-trimethylcyclohexane (trade name "Perhexa 3M-40") available from Nippon Oil & Fats Co., Ltd.

Preparation of Intermediate Layer Compositions and Cover Compositions

The formulation materials shown in Tables 5 to 8 were mixed using a kneading type twin-screw extruder to obtain pelletized intermediate layer compositions and cover compositions. The extrusion condition was, a screw diameter of 45 mm, a screw speed of 200 rpm, and a screw L/D of 35.

The formulation materials were heated at 200 to 260° C. at the die position of the extruder. The hardness for the intermediate layer ($H_M$) and hardness of the cover ($H_L$) were measured, using a sample of a stack of the three or more heat and press molded sheets having a thickness of about 2 mm from the resulting compositions for the intermediate layer and cover, which had been stored at 23° C. for 2 weeks, and the hardness differences ($H_L-H_M$) and ($H_M-H_S$) were determined by calculation. The results are shown in Tables 9 to 12. The test methods are described later.

TABLE 5

(parts by weight)

| | Example No. 1 | 2 | 3 | 4 | 5 | 6 |
|---|---|---|---|---|---|---|
| (Intermediate layer composition) | | | | | | |
| Surlyn 8945 *4 | 35 | 35 | 42.5 | 45 | 35 | 35 |
| Surlyn 9945 *5 | 35 | 35 | 42.5 | 45 | 35 | 35 |
| Hytrel 4047 *6 | 30 | — | 15 | — | — | 30 |
| Rabalon SR04 *7 | — | 30 | — | 10 | 30 | — |
| Hi-milan 1855 *8 | — | — | — | — | — | — |
| (Cover composition) | | | | | | |
| Surlyn 8945 *4 | — | — | — | — | 46 | — |
| Surlyn 9945 *5 | 40 | — | — | 40 | 37 | — |
| Hi-milan 1605 *9 | 60 | 60 | 60 | 60 | — | 60 |
| Hi-milan 1706 *10 | — | 40 | 40 | — | — | 40 |
| Hi-milan 1855 *8 | — | — | — | — | 10 | — |
| Pebax 2533 *11 | — | — | — | — | 5 | — |
| Epofriend A1010 *12 | — | — | — | — | 2 | — |
| Titanium dioxide | 4 | 4 | 4 | 4 | 4 | 4 |

TABLE 6

| | (parts by weight) | | | | | |
|---|---|---|---|---|---|---|
| | Example No. | | Comparative Example No. | | | |
| | 7 | 8 | 1 | 2 | 3 | 4 |
| (Intermediate layer composition) | | | | | | |
| Surlyn 8945 *4 | 25 | 35 | 35 | 35 | 35 | 35 |
| Surlyn 9945 *5 | 25 | 35 | 35 | 35 | 35 | 35 |
| Hytrel 4047 | — | 30 | 30 | 30 | — | 30 |
| Rabalon SR04 *7 | — | — | — | — | 30 | — |
| Hi-milan 1855 *8 | 50 | — | — | — | — | — |
| (Cover composition) | | | | | | |
| Surlyn 8945 *4 | — | — | — | — | — | — |
| Surlyn 9945 *5 | 40 | 40 | 40 | 40 | 40 | 40 |
| Hi-milan 1605 *9 | 60 | 60 | 60 | 60 | 60 | 60 |
| Hi-milan 1706 *10 | — | — | — | — | — | — |
| Hi-milan 1855 *8 | — | — | — | — | — | — |
| Pebax 2533 *11 | — | — | — | — | — | — |
| Epofriend A1010 *12 | — | — | — | — | — | — |
| Titanium dioxide | 4 | 4 | 4 | 4 | 4 | 4 |

TABLE 7

| | (parts by weight) Comparative Example No. | | | | | |
|---|---|---|---|---|---|---|
| | 5 | 6 | 7 | 8 | 9 | 10 |
| (Intermediate layer composition) | | | | | | |
| Surlyn 8945 *4 | 35 | 25 | 35 | 35 | 35 | 35 |
| Surlyn 9945 *5 | 35 | 25 | 35 | 35 | 35 | 35 |
| Hytrel 4047 *6 | — | — | 30 | — | 30 | 30 |
| Rabalon SR04 *7 | 30 | 50 | — | 30 | — | — |
| Hi-milan 1855 *8 | — | — | — | — | — | — |
| (Cover composition) | | | | | | |
| Surlyn 8945 *4 | — | — | 46 | 20 | — | — |
| Surlyn 9945 *5 | 40 | 40 | 38 | 20 | 40 | 40 |
| Hi-milan 1605 *9 | 60 | 60 | — | — | 60 | 60 |
| Hi-milan 1706 *10 | — | — | — | — | — | — |
| Hi-milan 1855 *8 | — | — | 9 | 60 | — | — |
| Pebax 2533 *11 | — | — | 5 | — | — | — |
| Epofriend A1010 *12 | — | — | 2 | — | — | — |
| Titanium dioxide | 4 | 4 | 4 | 4 | 4 | 4 |

TABLE 8

| | (parts by weight) Comparative Example No. | | | |
|---|---|---|---|---|
| | 11 | 12 | 13 | 14 |
| (Intermediate layer composition) | | | | |
| Surlyn 8945 *4 | 35 | 35 | — | — |
| Surlyn 9945 *5 | 35 | 35 | — | — |
| Dynaron DR6200P *13 | 30 | 30 | — | — |
| (Cover composition) | | | | |
| Hi-milan 1605 *9 | 50 | — | 50 | 50 |
| Hi-milan 1706 *10 | — | — | 50 | 50 |
| Hi-milan 1557 *14 | 50 | — | — | — |
| Hi-milan AM7311 *15 | — | 37 | — | — |
| Surlyn 7930 *16 | — | 37 | — | — |
| Nucrel AN4311 *17 | — | 26 | — | — |
| Titanium dioxide | 4 | 4 | — | — |

*4: Surlyn 8945 (trade name), ethylene-methacrylic acid copolymer ionomer resin obtained by neutralizing with sodium ion, manufactured by Du Pont Co.

*5: Surlyn 9945 (trade name), ethylene-methacrylic acid copolymer ionomer resin obtained by neutralizing with zinc ion, manufactured by Du Pont Co.

*6: Hytrel 4047 (trade name), polyester-based thermoplastic elastomer, which is commercially available from Toray-Du Pont Co., Ltd.

*7: Rabalon SR04 (trade name), styrene-ethylene-butylene-styrene (SEBS)-based thermoplastic elastomer, manufactured by Mitsubishi Chemical Co., Ltd., Shore A hardness: 40

*8: Hi-milan 1855 (trade name), ethylene-methacrylic acid-acrylic acid ester terpolymer ionomer resin obtained by neutralizing with zinc ion, manufactured by Mitsui Du Pont Polychemical Co., Ltd.

*9: Hi-milan 1605 (trade name), ethylene-methacrylic acid copolymer ionomer resin obtained by neutralizing with sodium ion, manufactured by Mitsui Du Pont Polychemical Co., Ltd.

*10: Hi-milan 1706 (trade name), ethylene-methacrylic acid copolymer ionomer resin obtained by neutralizing with zinc ion, manufactured by Mitsui Du Pont Polychemical Co., Ltd.

*11: Pebax 2533 (trade name), polyamide-based thermoplastic elastomer (hard segment: polyamide, soft segment: polyether block amide of polyether), manufactured by Toray Co., Ltd.

*12: Epofriend A1010 (trade name), styrene-butadiene-styrene (SBS) block copolymer with epoxy groups, manufactured by Daicel Chemical Industries, Ltd., JIS-A hardness = 67, styrene/butadiene (weight ratio) = 40/60, content of epoxy: about 1.5 to 1.7% by weight

*13: Dynaron DR6200P (trade name), C-EB-C (crystalline olefin-ethylene-butylene-crystalline olefin) - based block copolymer, available from JSR Co., Ltd.

*14: Hi-milan 1557 (trade name), ethylene-methacrylic acid copolymer ionomer resin obtained by neutralizing with zinc ion, manufactured by Mitsui Du Pont Polychemical Co., Ltd.

*15: Hi-milan AM7311 (trade name), ethylene-methacrylic acid copolymer ionomer resin obtained by neutralizing with magnesium ion, manufactured by Mitsui Du Pont Polychemical Co., Ltd.

*16: Surlyn 7930 (trade name), ethylene-methacrylic acid copolymer ionomer resin obtained by neutralizing with lithium ion, manufactured by Du Pont Co.

*17: Nucrel AN4311 (trade name), ethylene-methacrylic acid-acrylic acid ester terpolymer resin, manufactured by Du Pont-Mitsui Polychemicals Co., Ltd.

Formation of Intermediate Layer

The intermediate layer compositions were covered on the resulting center by directly injection molding to form an intermediate layer. The thickness of the resulting intermediate layer was measured, and the result is shown in Tables 9 to 12.

Production of Golf Ball

The cover compositions were covered on the resulting intermediate layer by injection molding to form a cover. The thickness of the resulting cover was measured, and the result is shown in Tables 9 to 12. Then, deflashing, surface pretreatment for painting, paint and the like, which are generally done on the surface of a golf ball, were conducted on the surface to produce a golf ball having a diameter of 42.75 mm. With respect to the resulting golf balls, the flight performance was measured, and the shot feel at the time of hitting were evaluated. The results are shown in Tables 13 to 16. As the flight performance, the launch angle, spin amount and flight distance (carry) when hit by a No. 1 wood club (W#1, a driver) and a No. 5 iron club (I#5) were measured. The test methods are as follows.

Test Method (1)Deformation Amount of Center

The deformation amount of center was determined by measuring a deformation amount when applying from an initial load of 98 N to a final load of 1275 N on the center.

(2) Hardness (i) Hardness of Center

The central point hardness, and the hardness at the distance of 5 mm, 10 mm and 15 mm from the central point of the center were determined by cutting the resulting center into two equal parts and then measuring a hardness at its central point and at the distance of 5, 10 and 15 mm from the central point in section. The surface hardness of the center was determined by measuring a hardness at the surface of the resulting center. The hardness was measured using a Shore D hardness meter according to ASTM D 2240-68.

(ii) Hardness of Intermediate Layer and Cover

The hardness of the intermediate layer and cover were determined by measuring a hardness, using a sample of a stack of the three or more heat and press molded sheets having a thickness of about 2 mm from the intermediate layer composition and cover composition, which had been stored at 23° C. for 2 weeks, with a Shore D hardness meter according to ASTM D 2240-68.

(3) Flight Performance (3-1) Flight Performance 1

After a No.1 wood club (W#1, a driver) was mounted to a swing robot manufactured by True Temper Co. and the golf ball was hit at a head speed of 35 m/sec, the launch angle, spin amount and flight distance were measured. The spin amount (backspin amount) was measured by continuously taking a photograph of a mark provided on the hit golf ball using a high-speed camera. As the flight distance, carry that is a distance to the drop point of the hit golf ball was measured. The measurement was conducted 5 times for each golf ball (n=5), and the average is shown as the result of the golf ball.

(3-2) Flight Performance 2

After a No. 5 iron club (I#5) was mounted to a swing robot manufactured by True Temper Co. and the golf ball was hit at a head speed of 30 m/sec, the launch angle, spin amount and flight distance were measured. The spin amount (backspin amount) was measured by continuously taking a photograph of a mark provided on the hit golf ball using a high-speed camera. As the flight distance, carry that is a distance to the drop point of the hit golf ball was measured. The measurement was conducted 5 times for each golf ball (n=5), and the average is shown as the result of the golf ball.

(4) Shot Feel

The shot feel of the golf ball is evaluated by 10 golfers according to a practical hitting test using a No. 1 wood club (W#1, a driver) having a metal head. The results shown in the Tables below are based on the fact that the most golfers evaluated with the same criterion about shot feel. The evaluation criteria are as follows.

Evaluation Criteria I (Trajectory)

○○: The golfers felt that the golf ball has good shot feel such that the launch angle is high and the flight distance is long.

x : The golfers felt that the golf ball has poor shot feel such that the launch angle is high but the flight distance is short.

xx: The golfers felt that the golf ball has poor shot feel such that the launch angle is low and the flight distance is short.

Evaluation Criteria II (Impact force)

○○: The golfers felt that the golf ball has soft and light and good shot feel.

○: The golfers felt that the golf ball has soft and good shot feel.

x : The golfers felt that the golf ball has hard and poor shot feel.

+: The golfers felt that the golf ball has heavy and poor shot feel.

TABLE 9

| | Example No. | | | | | |
|---|---|---|---|---|---|---|
| | 1 | 2 | 3 | 4 | 5 | 6 |
| (Center) | | | | | | |
| Deformation amount (mm) | 5.00 | 5.85 | 4.20 | 4.80 | 5.85 | 4.10 |
| Diameter (min) | 36.4 | 36.4 | 36.4 | 36.4 | 36.4 | 35.8 |
| Shore D hardness | | | | | | |
| Central point hardness $H_C$ | 23 | 18 | 31 | 33 | 18 | 29 |
| 5 mm from central point $H_5$ | 29 | 24 | 37 | 37 | 24 | 36 |
| 10 mm from central point $H_{10}$ | 36 | 29 | 42 | 40 | 29 | 41 |
| 15 mm from central point $H_{15}$ | 39 | 33 | 47 | 43 | 33 | 45 |
| Surface hardness $H_S$ | 40 | 34 | 49 | 44 | 34 | 46 |
| Difference ($H_S - H_C$) | 17 | 16 | 18 | 11 | 16 | 17 |
| (Intermediate layer) | | | | | | |
| Hardness $H_M$ (Shore D) | 58 | 50 | 59 | 58 | 50 | 58 |
| Difference ($H_M - H_S$) | 18 | 16 | 10 | 14 | 16 | 12 |
| Thickness (mm) | 1.6 | 1.6 | 1.6 | 1.6 | 1.6 | 1.2 |
| (Cover) | | | | | | |
| Hardness $H_L$ (Shore D) | 64 | 65 | 65 | 64 | 59 | 65 |
| Difference ($H_L - H_M$) | 6 | 15 | 6 | 6 | 9 | 7 |
| Thickness (mm) | 1.6 | 1.6 | 1.6 | 1.6 | 1.6 | 2.3 |
| Total number of dimples | 460 | 456 | 480 | 540 | 460 | 460 |
| Number of dimple D | 460 | 240 | 480 | 300 | 460 | 460 |

TABLE 10

| | Example No. | | Comparative Example No. | | | |
|---|---|---|---|---|---|---|
| | 7 | 8 | 1 | 2 | 3 | 4 |
| (Center) | | | | | | |
| Deformation amount (mm) | 5.00 | 5.00 | 4.70 | 5.00 | 6.30 | 3.40 |
| Diameter (mm) | 36.4 | 36.4 | 36.4 | 36.4 | 36.4 | 36.4 |
| Shore D hardness | | | | | | |
| Central point hardness $H_C$ | 23 | 23 | 36 | 23 | 16 | 44 |
| 5 mm from central point $H_5$ | 29 | 29 | 37 | 29 | 22 | 45 |
| 10 mm from central point $H_{10}$ | 36 | 36 | 38 | 36 | 28 | 46 |
| 15 mm from central point $H_{15}$ | 39 | 39 | 38 | 39 | 33 | 47 |
| Surface hardness $H_S$ | 40 | 40 | 39 | 40 | 34 | 47 |
| Difference ($H_S$–$H_C$) | 17 | 17 | 3 | 17 | 18 | 3 |
| (Intermediate layer) | | | | | | |
| Hardness $H_M$ (Shore D) | 59 | 58 | 58 | 58 | 50 | 58 |
| Difference ($H_M$–$H_S$) | 19 | 18 | 19 | 18 | 16 | 11 |
| Thickness (mm) | 1.6 | 1.6 | 1.6 | 1.6 | 1.6 | 1.6 |
| (Cover) | | | | | | |
| Hardness $H_L$ (Shore D) | 64 | 64 | 64 | 64 | 64 | 64 |
| Difference ($H_L$–$H_M$) | 5 | 6 | 6 | 6 | 14 | 6 |
| Thickness (mm) | 1.6 | 1.6 | 1.6 | 1.6 | 1.6 | 1.6 |
| Total number of dimples | 410 | 460 | 460 | 460 | 460 | 460 |
| Number of dimple D | 410 | 260 | 460 | 180 | 460 | 460 |

TABLE 11

| | Comparative Example No. | | | | | |
|---|---|---|---|---|---|---|
| | 5 | 6 | 7 | 8 | 9 | 10 |
| (Center) | | | | | | |
| Deformation amount (mm) | 4.80 | 5.00 | 5.00 | 5.00 | 4.70 | 4.70 |
| Diameter (mm) | 36.4 | 36.4 | 36.4 | 36.4 | 36.4 | 35.8 |
| Shore D hardness | | | | | | |
| Central point hardness $H_C$ | 31 | 23 | 23 | 23 | 28 | 28 |
| 5 mm from central point $H_5$ | 34 | 29 | 29 | 29 | 34 | 33 |
| 10 mm from central point $H_{10}$ | 37 | 36 | 36 | 36 | 38 | 39 |
| 15 mm from central point $H_{15}$ | 36 | 39 | 39 | 39 | 42 | 42 |
| Surface hardness $H_S$ | 36 | 40 | 40 | 40 | 42 | 42 |
| Difference ($H_S$–$H_C$) | 5 | 17 | 17 | 17 | 14 | 14 |
| (Intermediate layer) | | | | | | |
| Hardness $H_M$ (Shore D) | 50 | 46 | 58 | 50 | 58 | 58 |
| Difference ($H_M$–$H_S$) | 14 | 6 | 18 | 10 | 16 | 16 |
| Thickness (mm) | 1.6 | 1.6 | 1.6 | 1.6 | 0.9 | 0.9 |
| (Cover) | | | | | | |
| Hardness $H_L$ (Shore D) | 64 | 64 | 59 | 56 | 64 | 64 |
| Difference ($H_L$–$H_M$) | 14 | 18 | 1 | 6 | 6 | 6 |
| Thickness (mm) | 1.6 | 1.6 | 1.6 | 1.6 | 2.3 | 2.6 |
| Total number of dimples | 460 | 460 | 460 | 460 | 392 | 392 |
| Number of dimple D | 460 | 460 | 460 | 460 | 392 | 392 |

TABLE 12

| | Comparative Example No. | | | |
|---|---|---|---|---|
| | 11 | 12 | 13 | 14 |
| (Center) | | | | |
| Deformation amount (mm) | 5.20 | 4.80 | 3.10 | 3.10 |
| Diameter (mm) | 36.4 | 36.4 | 38.8 | 38.8 |

TABLE 12-continued

| | Comparative Example No. | | | |
|---|---|---|---|---|
| | 11 | 12 | 13 | 14 |
| Shore D hardness | | | | |
| Central point hardness $H_C$ | 30 | 35 | 41 | 41 |
| 5 mm from central point $H_5$ | 33 | 38 | 43 | 43 |
| 10 mm from central point $H_{10}$ | 36 | 42 | 45 | 45 |
| 15 mm from central point $H_{15}$ | 39 | 45 | 46 | 46 |

TABLE 12-continued

| | Comparative Example No. | | | |
|---|---|---|---|---|
| | 11 | 12 | 13 | 14 |
| Surface hardness $H_S$ | 38 | 47 | 45 | 45 |
| Difference ($H_S$–$H_C$) | 8 | 12 | 4 | 4 |
| (Intermediate layer) | | | | |
| Hardness $H_M$ (Shore D) | 55 | 55 | — | — |
| Difference ($H_M$–$H_S$) | 17 | 8 | — | — |
| Thickness (mm) | 1.6 | 1.6 | — | — |
| (Cover) | | | | |
| Hardness $H_L$ (Shore D) | 60 | 61 | 64 | 64 |
| Difference ($H_L$–$H_M$) | 5 | 6 | — | — |
| Thickness (mm) | 1.5 | 1.5 | 2.0 | 2.0 |
| Total number of dimples | 392 | 432 | 392 | 460 |
| Number of dimple D | 392 | 432 | 392 | 460 |

TABLE 13

| | Example No. | | | | | |
|---|---|---|---|---|---|---|
| | 1 | 2 | 3 | 4 | 5 | 6 |
| (Physical properties of golf ball) | | | | | | |
| Flight performance 1 (W#1, 35 m/sec) | | | | | | |
| Launch angle (°) | 11.7 | 11.8 | 11.7 | 11.6 | 11.7 | 11.6 |
| Spin amount (rpm) | 2800 | 2700 | 2700 | 2800 | 2800 | 2700 |
| Carry (m) | 147.2 | 146.3 | 148.1 | 147.2 | 146.3 | 148.1 |
| Flight performance 2 (I#5, 30 m/sec) | | | | | | |
| Launch angle (°) | 13.8 | 13.9 | 13.9 | 13.7 | 13.7 | 13.7 |
| Spin amount (rpm) | 3500 | 3500 | 3600 | 3600 | 3600 | 3500 |
| Carry (m) | 120.7 | 121.2 | 120.7 | 120.2 | 119.8 | 121.6 |
| Shot feel | | | | | | |
| Trajectory | oo | oo | oo | oo | oo | oo |
| Impact force | oo | oo | oo | oo | oo | oo |

TABLE 14

| | Example No. | | Comparative Example No. | | | |
|---|---|---|---|---|---|---|
| | 1 | 2 | 3 | 4 | 5 | 6 |
| (Physical properties of golf ball) | | | | | | |
| Flight performance 1 (W#1, 35 m/sec) | | | | | | |
| Launch angle (°) | 11.7 | 11.7 | 11.4 | 11.7 | 11.6 | 11.3 |
| Spin amount (rpm) | 2700 | 2800 | 3000 | 2800 | 2800 | 3100 |
| Carry (m) | 147.2 | 146.3 | 144.5 | 144.5 | 141.7 | 142.6 |
| Flight performance 2 (I#5, 30 m/sec) | | | | | | |
| Launch angle (°) | 13.8 | 13.8 | 13.2 | 13.8 | 13.3 | 13.1 |
| Spin amount (rpm) | 3500 | 3500 | 3900 | 3500 | 3800 | 4000 |
| Carry (m) | 119.8 | 119.8 | 118.0 | 118.4 | 117.5 | 117.0 |
| Shot feel | | | | | | |
| Trajectory | oo | oo | xx | x | x | xx |
| Impact force | oo | oo | x+ | oo | o | x+ |

TABLE 15

| | Comparative Example No. | | | | | |
|---|---|---|---|---|---|---|
| | 5 | 6 | 7 | 8 | 9 | 10 |
| (Physical properties of golf ball) | | | | | | |
| Flight performance 1 (W#1, 35 m/sec) | | | | | | |
| Launch angle (°) | 11.4 | 11.5 | 11.3 | 11.3 | 11.4 | 11.6 |
| Spin amount (rpm) | 3000 | 2900 | 3100 | 3200 | 2900 | 2900 |
| Carry (m) | 143.6 | 143.6 | 143.6 | 142.6 | 144.5 | 145.4 |
| Flight performance 2 (I#5, 30 m/sec) | | | | | | |
| Launch angle (°) | 13.3 | 13.4 | 13.3 | 13.1 | 13.7 | 13.8 |
| Spin amount (rpm) | 3900 | 3900 | 3900 | 4100 | 3600 | 3600 |
| Carry (m) | 117.5 | 118.0 | 118.4 | 117.0 | 120.2 | 120.7 |
| Shot feel | | | | | | |
| Trajectory | xx | xx | xx | xx | x | x |
| Impact force | x+ | + | x+ | + | x | x+ |

TABLE 16

| | Comparative Example No. | | | |
|---|---|---|---|---|
| | 11 | 12 | 13 | 14 |
| (Physical properties of golf ball) | | | | |
| Flight performance 1 (W#1, 35 m/sec) | | | | |
| Launch angle (°) | 11.3 | 11.4 | 11.2 | 11.2 |
| Spin amount (rpm) | 3100 | 3000 | 3100 | 3100 |
| Carry (m) | 143.6 | 144.5 | 141.7 | 142.6 |
| Flight performance 2 (I#5, 30 m/sec) | | | | |
| Launch angle (°) | 13.3 | 13.2 | 13.0 | 13.0 |
| Spin amount (rpm) | 3900 | 3900 | 4000 | 4000 |
| Carry (m) | 117.0 | 117.5 | 117.0 | 117.5 |
| Shot feel | | | | |
| Trajectory | xx | xx | xx | xx |
| Impact force | x+ | + | x+ | x+ |

As is apparent from Tables 13 and 16, the golf balls of Examples 1 to 8 of the present invention, when compared with the golf balls of Comparative Examples 1 to 14, had excellent flight performance, while maintaining good shot feel, and when hit at low head speed, they had excellent flight performance by accomplishing high launch angle and low spin amount.

On the other hand, in the golf ball of Comparative 10 Example 1, since the hardness difference ($H_S$–$H_C$) between the surface hardness ($H_S$) and center hardness ($H_C$) of the center is small, the launch angle is low and the spin amount is high, which reduces the flight distance. In addition, the shot feel is hard and poor.

In the golf ball of Comparative Example 2, the launch angle is low and the spin amount is high, but the number of the dimple D having an angle between a radial tangent line (A) at the dimple edge and a tangent line (B) at the dimple edge of a circle drawn through the dimple edge and the deepest point of the dimple is within the range of 8 to 25° is small, which reduces the flight distance.

In the golf ball of Comparative Example 3, since the central point hardness of the center is low, the rebound characteristics are degraded, which reduces the flight distance. In addition, the deformation amount of the center is large, and the center is soft, but the resulting golf ball has poor shot feel such that the flight distance is short.

In the golf ball of Comparative Example 4, the central point hardness of the center is high, and the hardness difference ($H_S$–$H_C$) is small; the deformation amount is small, and the center is too hard, which degrades the shot feel; and the launch angle is low and the spin amount is high, which reduces the flight distance.

In the golf ball of Comparative Example 5, since the $H_{15}$ and $H_S$ are higher than $H_{10}$ in the center, the launch angle is low and the spin amount is high, which reduces the flight distance, or the shot feel is heavy and poor.

In the golf ball of Comparative Example 6, since the hardness of the intermediate layer is low, and the hardness difference ($H_L$–$H_M$) is large and the hardness difference ($H_M$–$H_S$) is small. Therefore, the launch angle is low and the spin amount is high, which reduces the flight distance, or the shot feel is heavy and poor.

In the golf ball of Comparative Example 7, since the hardness difference ($H_L$–$H_M$) is small, and the launch angle is low and the spin amount is high, which reduces the flight distance, or the shot feel is hard and heavy and poor.

In the golf ball of Comparative Example 8, since the cover hardness ($H_L$) is low, the rebound characteristics are degraded, the launch angle is low and the spin amount is high, which degrades the flight performance, or the shot feel is heavy and poor.

In the golf ball of Comparative Example 9, since the thickness of the intermediate layer is small, the launch angle is low, which degrades the flight performance, or the shot feel is hard and poor.

In the golf ball of Comparative Example 10, since the thickness of the intermediate layer is small, the launch angle is low, which degrades the flight performance, or the thickness of the cover is large, and the shot feel is hard and heavy and poor.

In the golf ball of Comparative Example 11, since the H15 is higher than the HS in the center and the hardness difference ($H_S$–$H_C$) is small, the launch angle is low and the spin amount is high, which degrades the flight performance, or the shot feel is hard and heavy and poor.

In the golf ball of Comparative Example 12, since the hardness difference ($H_M$–$H_S$) is small, the launch angle is low and the spin amount is high, which reduces the flight distance, or the shot feel is heavy and poor.

In the golf ball of Comparative Example 13, since the hardness difference ($H_S$–$H_C$) is small and the deformation amount is small, the resulting golf ball is too hard, and the shot feel is hard and heavy and poor. In addition, the launch angle is low and the spin amount is high, which reduces the flight distance.

In the golf ball of Comparative Example 14, since the hardness difference ($H_S$–$H_C$) is small and the deformation amount is small, the resulting golf ball is too hard, and the shot feel is hard and heavy and poor. In addition, the launch angle is low and the spin amount is high, which reduces the flight distance.

Figure 4:
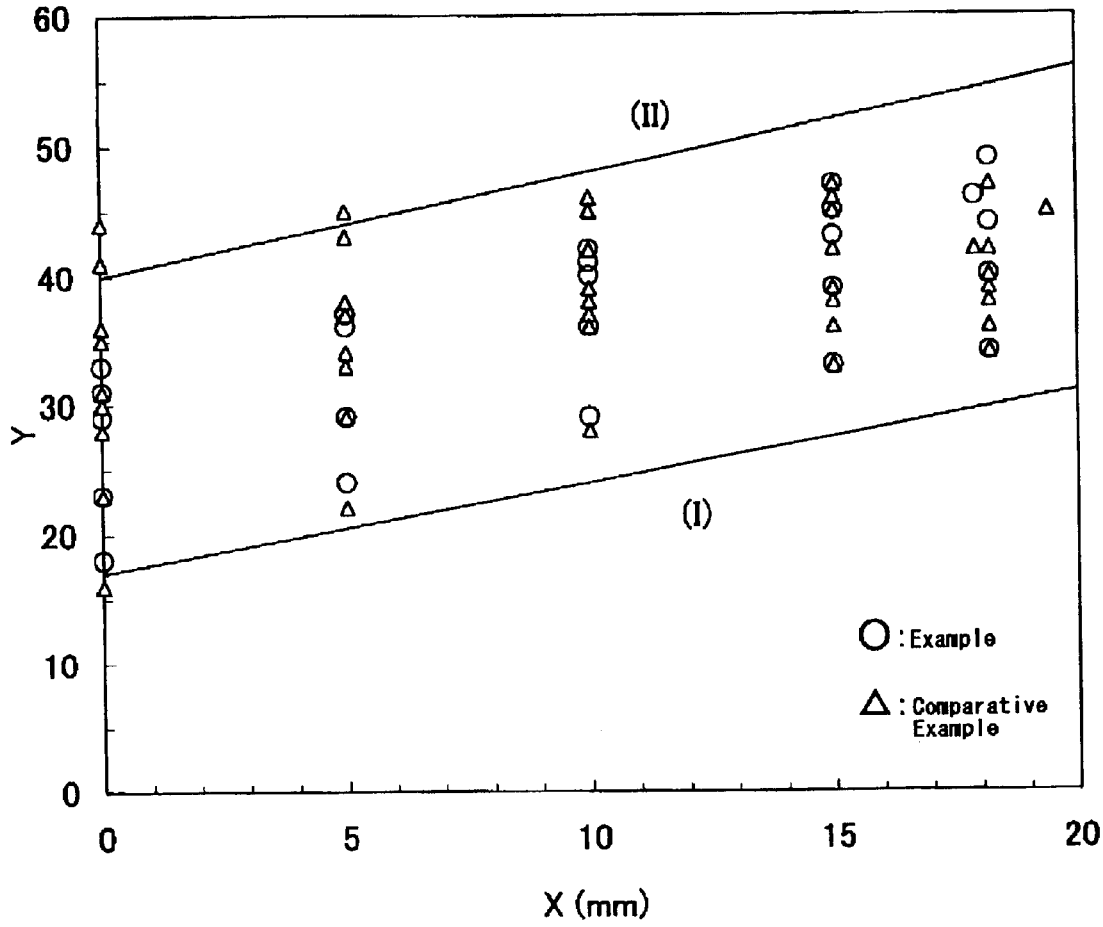
FIG. 4 is a graph illustrating the correlation of the distance X (mm) from the central point of the center with the Shore D hardness (Y) measured at the distance.

With respect to the hardness $H_C$ to $H_S$ of the center in the golf balls of Examples 1 to 8 and Comparative Examples 1 to 14, a graph illustrating the correlation of the value of Y (Shore D hardness at the distance X) with the value of X (a distance (mm) from the central point of the center) from the results of Tables 9 to 12 is FIG. 4. the X and Y satisfy a correlation represented by the following formula:

$$0.7X+17 \leqq Y \leqq 0.8X+40$$

As is apparent from FIG. 4, all plots of the golf balls of the present invention of Examples 1 to 8 are on the line or within the area having higher Y value than the line represented by the following formula:

$$Y=0.7X+17 \quad \text{(I)}$$

and are on the line or within the area having lower Y value than the line represented by the following formula:

$$Y=0.8X+40 \quad \text{(II)}$$

That is, in the golf balls of the present invention of Examples 1 to 8, the values of Y and X are all represented by the formula:

$$0.7X+17 \leqq Y \leqq 0.8X+40$$

On the other hand, the plots of the golf balls of Comparative Examples 3 ($H_C$), 4 ($H_C$ and $H_5$), 13 ($H_C$) and 14 ($H_C$) are out of the range. Particularly, the golf balls of Comparative Examples 3 and 4 satisfy a correlation represented by the formula:

$$H_C<H_5<H_{10}<H_{15} \leqq H_S$$

However, in the golf ball of Comparative Example 3, the HC is within the area having lower Y value than the line represented by the following formula:

$$Y=0.7X30\ 17$$

and the flight distance is short. In the golf ball of Comparative Example 4, the $H_C$ and $H_5$ are within the area having higher Y value than the line represented by the following formula:

$$Y=0.8X+40$$

and the shot feel is hard and poor.

Therefore, when the hardness of the center satisfies the correlation represented by the following formula (1):

$$H_C<H_5<H_{10}<H_{15} \leqq H_S \quad (1)$$

but does not satisfy the correlation represented by the following formula (2):

$$0.7X+17 \leqq Y \leqq 0.8X+40 \quad (2)$$

that is, when the hardness of the center is within the area represented by the following formula:

$$Y>0.8X+40$$

the shot feel of the resulting golf ball is hard and poor. When the hardness of the center is within the area represented by the following formula:

$$Y<0.7X+17$$

the rebound characteristics are degraded, and the flight performance is degraded.

What is claimed is:

1. A three-piece solid golf ball comprising a center, an intermediate layer formed on the center and a cover covering the intermediate layer, of which the surface of the cover has many dimples, wherein the center has a deformation amount of 4.0 to 6.0 mm, when applying from an initial load of 98 N to a final load of 1275 N, a central point hardness in Shore D hardness ($H_C$) of 17 to 40, a surface hardness in Shore D hardness ($H_S$) of 30 to 55 and a difference ($H_S$–$H_C$) between the surface hardness and central point hardness of 10 to 20, assuming that Shore D hardness at the distance of 5, 10 and 15 mm from the central point of the center is represented by $H_5$, $H_{10}$ and $H_{15}$, respectively, the $H_5$, $H_{10}$ and $H_{15}$ satisfy a correlation represented by the following formula: $H_C<H_5<H_{10}<H_{15}\leqq H_S$, and assuming that a distance from the central point of the center is represented by X (mm) and Shore D hardness at the distance X is represented by Y, the X and Y satisfy a correlation represented by the following formula:

$$0.7X+17\leqq Y\leqq 0.8X+40$$

the intermediate layer is mainly formed from thermoplastic resin, and has a hardness in Shore D hardness ($H_M$) of 48 to 62 and thickness of 1.0 to 1.8 mm, the cover is mainly formed from thermoplastic resin, and has a hardness in Shore D hardness ($H_L$) of 58 to 72 and thickness of 1.0 to 2.5 mm, the $H_S$, $H_M$ and $H_L$ satisfy a correlation represented by the following formula:

$$H_S<H_M<H_L$$

and a hardness difference ($H_L-H_M$) is within the range of 5 to 15 and a hardness difference ($H_M-H_S$) is within the range of 10 to 20, and a number of the dimple having an angle between a radial tangent line (A) at the dimple edge and a tangent line (B) at the dimple edge of a circle drawn through the dimple edge and the deepest point of the dimple is within the range of 8 to 25° is not less than 50%, based on total number of the dimples in the golf ball.

2. The three-piece solid golf ball according to claim 1, wherein the intermediate layer and the cover are formed from thermoplastic resin comprising ionomer resin as a main component.

3. The three-piece solid golf ball according to claim 1, wherein the total number of the dimple is within the range of 450 to 540.

* * * * *